United States Patent [19]

Giorgi

[11] Patent Number: 4,940,300

[45] Date of Patent: Jul. 10, 1990

[54] CATHODE RAY TUBE WITH AN ELECTROPHORETIC GETTER

[75] Inventor: Ettore Giorgi, Milan, Italy

[73] Assignee: SAES Getters SpA, Milan, Italy

[21] Appl. No.: 709,650

[22] Filed: Mar. 8, 1985

[30] Foreign Application Priority Data

Mar. 16, 1984 [IT] Italy ..... 20096 A/84

[51] Int. Cl.[5] ..... H01J 17/24; H01J 31/00

[52] U.S. Cl. ..... 313/559; 313/481; 313/558; 252/181.5; 252/181.6

[58] Field of Search ..... 313/481, 558, 559; 204/181.4, 180.2, 299 EC; 252/181.1, 181.2, 181.5, 181.6, 181.7; 502/242, 527

[56] References Cited

U.S. PATENT DOCUMENTS

| | | | |
|---|---|---|---|
| 3,121,182 | 2/1964 | Hui et al. | 313/481 |
| 3,203,901 | 8/1965 | Della Porta | 252/181.6 |
| 3,264,510 | 8/1966 | Griffiths | 313/481 |
| 3,394,874 | 7/1968 | Marshall | 313/481 |
| 3,584,253 | 6/1971 | Wintzer | 313/180 |
| 3,652,317 | 3/1972 | Della Porta et al. | 252/181.7 |
| 3,856,709 | 12/1974 | Della Porta et al. | 252/463 |
| 3,926,832 | 12/1975 | Barosi | 252/181.6 |
| 3,975,304 | 8/1976 | Della Porta et al. | 252/463 |
| 4,051,004 | 9/1977 | Sunamori et al. | 204/181.4 |
| 4,306,887 | 12/1981 | Barosi et al. | 55/68 |
| 4,428,856 | 1/1984 | Boyarina et al. | 252/181.1 |

FOREIGN PATENT DOCUMENTS

| | | |
|---|---|---|
| 1533487 | 11/1978 | United Kingdom . |
| 2077487 | 12/1981 | United Kingdom . |

OTHER PUBLICATIONS

Espe, W., *Zirkonium, Seine Herstellung, Eigenschaften and Anwendungen in der Vakuumtechnik*, G. F. Winter'sche Verlagshandlung, Fussen/Bayern, 1953.

*Primary Examiner*—Robert L. Griffin
*Assistant Examiner*—Ted Salindong
*Attorney, Agent, or Firm*—David R. Murphy

[57] ABSTRACT

A cathode ray tube with an electrophoretic getter device incorporated therein is described. The electrophoretic deposition, in the form of a porous coating, of at least one getter material and simultaneously an antisintering agent on any form of getter support is also described. The getter material may be a powder of a metal, of a metal alloy or of a hydride thereof, or a mixture of these components.

5 Claims, 5 Drawing Sheets

FIG. 9
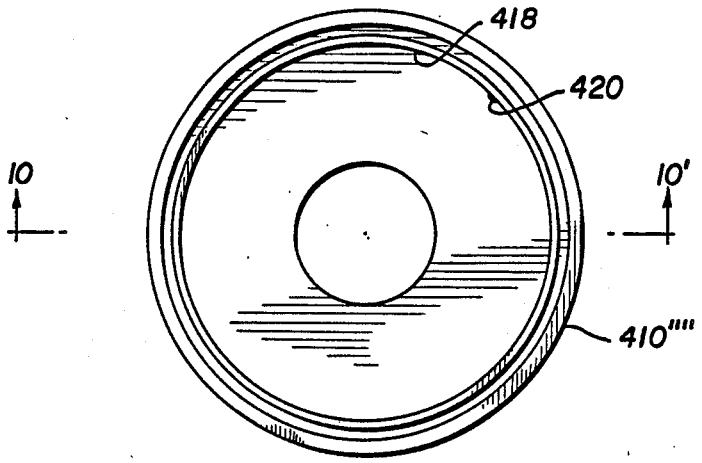
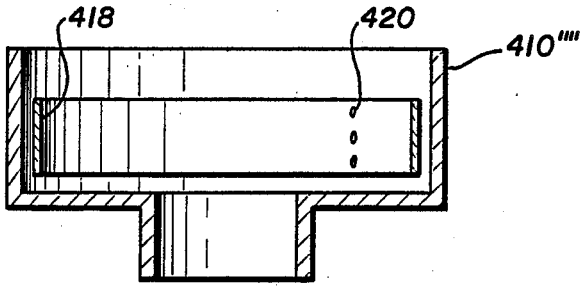
FIG. 10

CATHODE RAY TUBE WITH AN ELECTROPHORETIC GETTER

Non-evaporable getter devices are well known in the art. They are used to remove unwanted gases from evacuated or rare gas filled vessels such as electron tubes. They can also be used to remove gases selectively from an atmosphere such as nitrogen within the jacket of high intensity discharge lamps. Many different materials have been proposed for use as non-evaporable getters. For example Della Porta in U.S. Pat. No. 3,203,901 describes the use of a Zr-Al alloy and especially an alloy containing 84% wt Zr, remainder Al. UK Pat. No. 1,533,487 describes the gettering composition $Zr_2Ni$. Zr-Fe alloys containing from 15% to 30% wt of Fe, balance Zr, have been described in U.S. Pat. No. 4,306,887. Ternary alloys have also been described such as Zr-Ti-Fe and Zr-$M_1$-$M_2$ in which $M_1$ is a metal chosen from the group consisting of vanadium and niobium and in which $M_2$ is a metal chosen from the group consisting of iron and nickel. Gettering compositions based on titanium are also known (see for example U.S. Pat. No. 4,428,856). These getter materials are normally used in the form of a finely divided powder having a particle size generally less than about 125 $\mu$. The powdered getter material can be compressed so as to form a pill or self-supporting tablet, or the getter material can be pressed into a ring-shaped container having a U-shaped cross-section. Such getter devices can be relatively large and have the disadvantage that usually only the outer layers of the powder getter material are able to sorb gas, while the inner particles do not contribute to the gas sorption process and are a waste of costly getter material.

To try and overcome the disadvantages of the use of getter materials in the form of pills or compressed tablets, or their use in ring containers, della Porta et al in U.S. Pat. No. 3,652,317 have described a method of mechanically manufacturing a substrate having a coating of getter material particles with a high surface area to mass ratio. However this method, even if it provides a considerable saving of getter material, is very complex and requires the use of expensive machinery.

It is also difficult to control the thickness of the coating formed, with the consequence that the getter device does not have uniform characteristics.

This mechanical method of coating a substrate with particles can only be used if the particles are much harder than the substrate. If the particles are only slightly harder, or are even softer than the substrate, then during the mechanical coating process they tend to undergo plastic deformation and weld to each other. As a consequence the coating has a low surface area to mass ratio with poor adhesion to the substrate. Della Porta et al in U.S. Pat. Nos. 3,856,709 and 3,975,304 suggest the addition of hard particles to the soft particles to obtain a coating of soft particles on the substrate with a high surface area to mass ratio. However this method of coating still requires the use of costly machinery and it is still difficult to control the thickness of the coating produced.

Neither of the latter two methods proposed is able to give a satisfactory coating on a substrate which has a thickness comparable to that of the coating or less than that thickness due to penetration of the particles which provoke excessive deformation of the substrate and even its complete penetration. Furthermore the particles are not firmly attached to the substrate. It is also difficult or impossible to use these methods for coating anything other than a long continuous strip of support material. In no case is it possible to coat the strip if it is too hard.

In order to manufacture getter devices having a high porosity, such that a significant amount of the getter material within the body of the device is able to sorb gas, Wintzer has proposed in U.S. Pat. No. 3,584,253, the use of Zr powder intimately mixed with powdered graphite as an antisintering agent so as to maintain a large surface of the gas sorbing material. It has been found that such a composite gettering material has the ability to sorb gas even at room temperature. U.S. Pat. No. 3,926,832 (Barosi) and UK Patent Application No. 2,077,487 A filed in the name of the present applicant, describe other porous getter materials in which the antisintering agent comprises a Zr-based getter alloy.

Unfortunately the industrial scale production of such porous non-evaporable getter devices is lengthy and requires much labor. One technique used for the preparation of getter devices using the composite getter material is that of preparing a viscous suspension of the composite material in an organic liquid and then individually painting the supports with this suspension. However it is very difficult or impossible to control the amount of getter material applied to each support. The use of flammable organic liquids, which may also be toxic, is a risk for the personnel and furthermore, even with the painting technique it may be difficult or impossible to cover some shapes of getter materials support. An alternative technique is that of using a mold into which the composite getter material mixture is poured. However, this requires an individual mold for each getter device and is therefore again a costly technique which requires excessive time. W. Espe in the book "Zirkonium, Seine Herstellung, Eigenschaften and Anwendungen in der Vakuumtechnik", C. F. Winter'sche Verlagshandlung, Fussen/Bayern, 1953, describes a process for the deposition of Zr and Zr hydride by means of electrophoresis, but the coating obtained has a low porosity.

It is therefore an object of the present invention to provide a method for the manufacture of non-evaporable getter devices which are substantially free from one or more disadvantages of the prior methods.

It is another object of the present invention to provide a method for the manufacture of non-evaporable getter devices which avoids the use of excessive amounts of getter material.

It is yet another object of the present invention to provide a method for the manufacture of non-evaporable getter devices without the use of costly or complicated production equipment.

It is a further object of the present invention to provide a method for the manufacture of getter devices which is suitable for mass production and requires a minimum number of personnel with minimum risk to the personnel.

Another object of the present invention is to provide a method for manufacturing of non-evaporable getter devices having more reproducible mechanical and gas sorption characteristics.

Yet another object of the present invention is to provide a method for the manufacture of non-evaporable getter devices which have practically any shape and size of support.

Still another object of the present invention is to provide improved cathode ray tubes comprising a non-evaporable getter device manufactured by a method substantially free from one or more disadvantages of the prior methods.

An additional object of the present invention is to provide an improved cathode ray tube which is substantially free from one or more disadvantages of prior cathode ray tubes.

Further objects and advantages of the present invention will become evident with reference to the following detailed description and drawings wherein.

Figure 2:
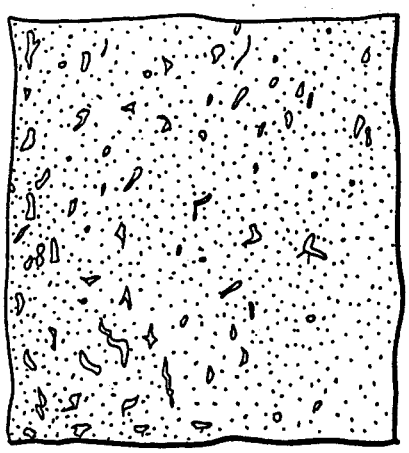
FIG. 2 is a scanning electron microscope photomicrograph of the surface of a getter device produced according to the method of the present invention before having been submitted to the sintering process.
Figure 5:
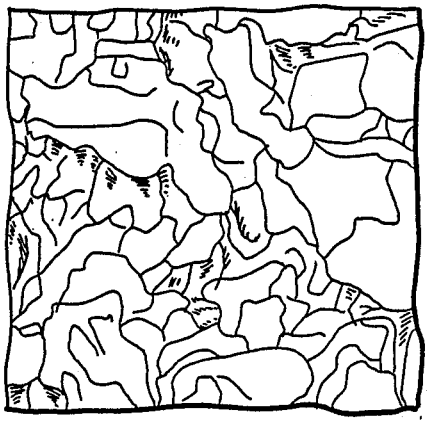
Figure 6:
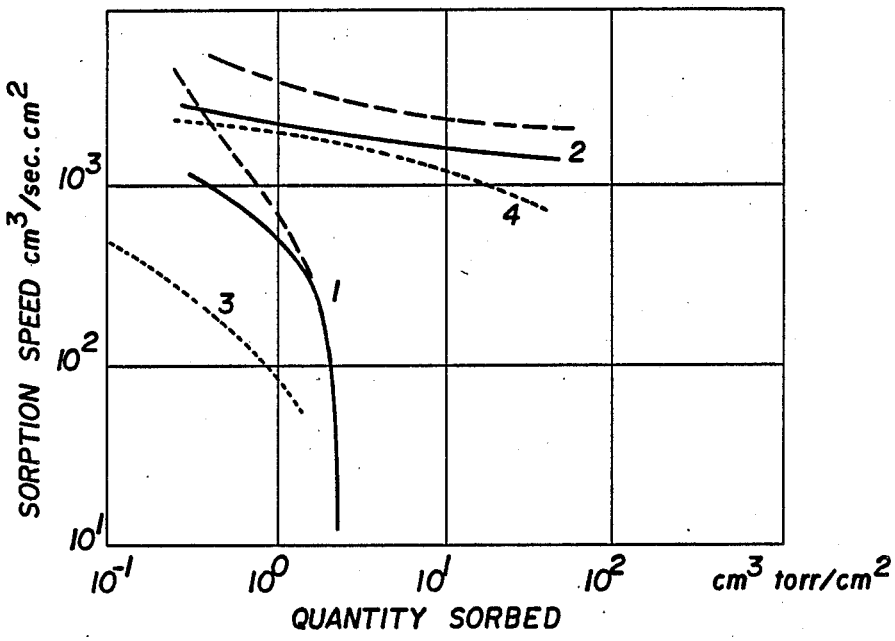
Figure 7:
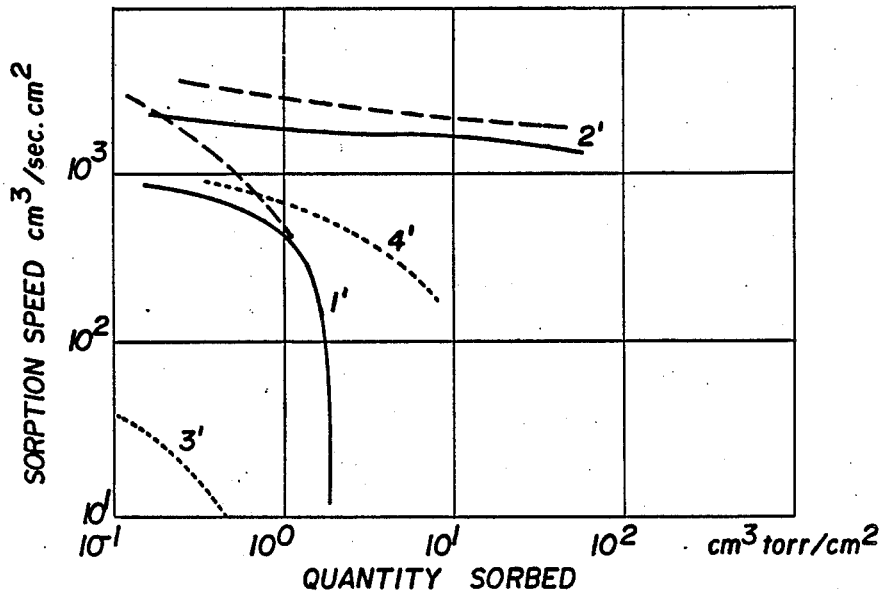
Figure 8:
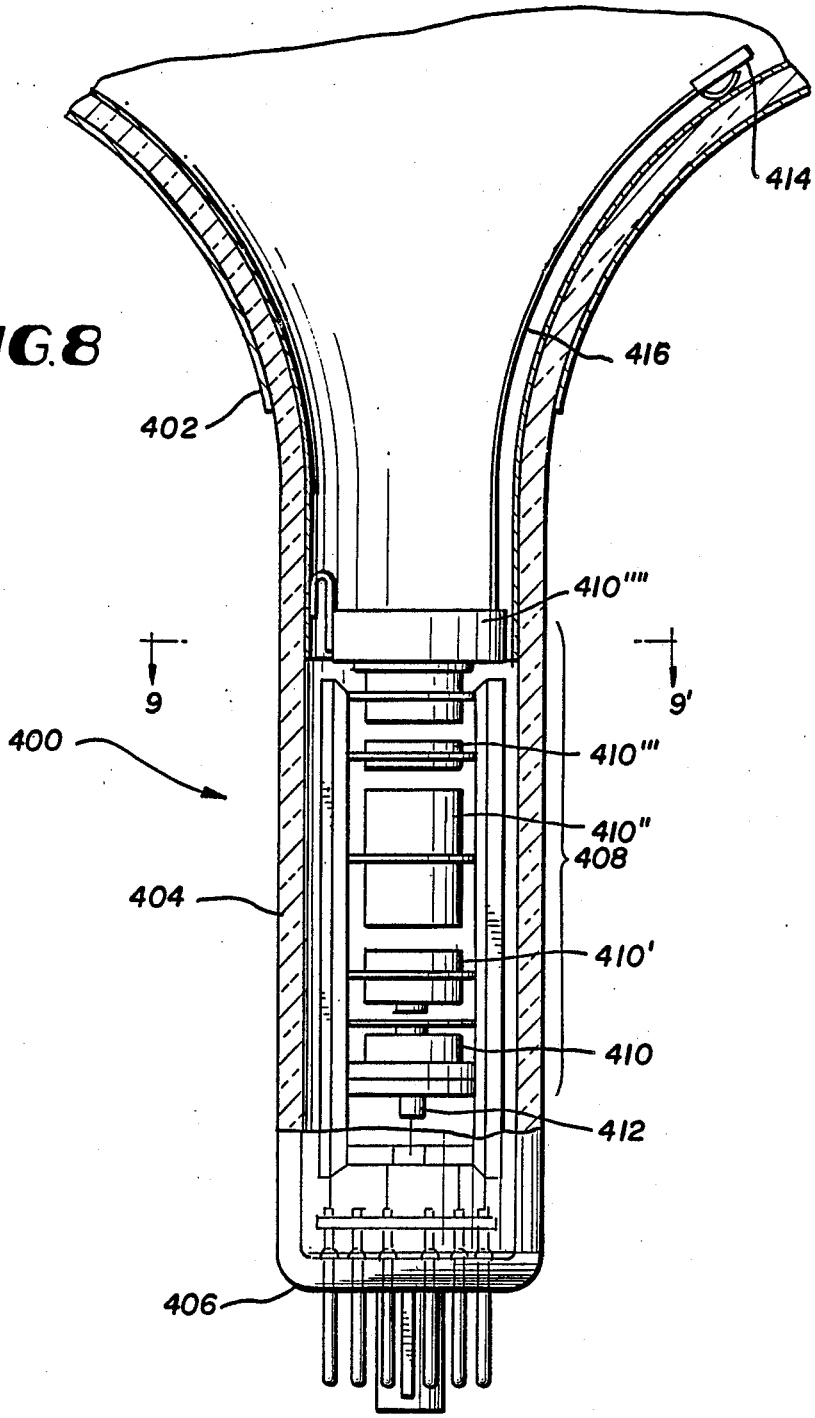

FIG. 5 is an enlargement of a portion of the surface shown in FIG. 2, but after the getter device has been submitted to the sintering process; and FIGS. 6 and 7 are graphs comparing the sorption characteristics, for hydrogen and carbon monoxide, of getter devices produced according to the present invention with those produced according to traditional techniques; and FIG. 8 is a cross-sectional view of a cathode ray tube; and FIG. 9 is a cross-sectional view taken along Line 9—9' of FIG. 8; and FIG. 10 is a cross-sectional view taken along Line 10—10' of FIG. 9.

The present invention provides a method for the manufacture of a getter device by means of the electrophoretic deposition of at least one powdered getter material simultaneously with a powdered antisintering agent on a support having any desired form. For example it may be in the form of a metal wire of any desired diameter. The wire may be straight or it could be bent into any desired shape such as, for example, a spiral or a fibilar winding for use as a heater in the getter device itself. The wire may previously have been coated with an insulating material such as alumina. The support could also, for instance, be in the form of a strip or ribbon of metal such as stainless steel or iron or nickel plated iron. Alternatively it may be of a high electrical resistance metal such as nichrome or it may be graphite. The strip may be bent into any desired shape prior to depositing electrophoretically the getter material and antisintering agent coating such as a cylinder or a zigzag or concertina fashion. Whatever the shape of the getter support it is coated electrophoretically by immersion in a suspension of particles of at least one getter material and an antisintering agent in a liquid. Between the getter support, which acts as first electrode, and a second electrode there is passed direct electric current which causes the deposition of powdered getter material and antisintering agent which coats the getter support. This support and its coating are then removed from the suspension and allowed to dry. The coated support is then placed in a vacuum oven in which there is maintained a pressure less than about $10^{-3}$ Torr ($10^{-1}$ Pa) and heated to a temperature less than about 1100° C. The getter with its support is then allowed to cool down to room temperature whereupon it is removed from the vacuum oven and is ready for use. The getter device exhibits no loose particles and has a high resistance to mechanical compression, vibration and shock.

A getter device produced in this way is particularly suitable for use when high sorption speeds are required such as in image intensifiers, vidicon television camera tubes, for various components of vacuum electron tubes and even for kinescopes when the formation of a layer of barium on the inner surfaces must be absolutely avoided, as well as on deflectors or baffles or turbomolecular pumps, and also for electrodes and components associated with ion pumps.

The getter material in suspension comprises at least one powder of a metal or of a metal alloy or of their hydrides or of a mixture of these components. If it is desired to use a metal or metal hydride as the getter material then it is preferably chosen from the group consisting of Zr, Ta, Hf, Nb, Ti, Th and uranium or a hydride thereof or a mixture thereof. The more preferred getter materials are Ti and Zr and more preferably their hydrides.

The antisintering agent in suspension may, for example, be graphite or refractory metal such as W, Mo, Nb and Ta. If it is desired to use an antisintering agent which also has gettering properties it is preferable to use a getter metal alloy. One preferred binary alloy with these properties is a Zr-Al alloy comprising from 5 to 30% wt of Al (balance Zr). The more preferred Zr-Al alloy is an alloy having 84% wt of Zr and 16% wt of Al. Other binary alloys suitable for use in the process of the present invention are, for example, Zr-Ni alloys or Zr-Fe alloys. Ternary alloys can also be used such as Zr-Ti-Fe alloys or preferably Zr-$M_1$-$M_2$ alloys, which $M_1$ is a metal chosen from the group: vanadium and niobium, and $M_2$ is a metal chosen from the group: nickel and iron. The most preferred ternary alloy is a Zr-V-Fe alloy.

It has been found that if the particles of the components in suspension have a particle size greater than about 100 $\mu$ then they are not capable of being deposited electrophoretically whereas if the particle size is too small then it is not possible to form a porous coating. The powders should therefore have a particle size less than about 100 $\mu$ and preferably less than about 60 $\mu$. Preferably they should have a particle size greater than about 20 $\mu$ and have an average particle size of about 40 $\mu$.

When the getter material (first powder) is deposited electrophoretically together with the antisintering agent (second powder), the weight ratio of the first powder to the second powder can have any desired value.

However the preferred ratio of getter material to antisintering material is between 5:1 and 1:4 and the more preferred ratio is between 3.5:1 and 2:1.

The liquid in which the getter material and antisintering agent is suspended is any liquid from which the getter material and antisintering agent may be electrophoretically deposited. It preferably comprises water and more preferably distilled water in which there has been dissolved a water miscible organic compound.

Suitable organic compounds are liquid organic compounds or their mixtures, such as alcohols, ketones or esters, and especially alkanols. For the electrophoretic deposition of getter materials the preferred organic compound is ethyl alcohol, as it is not toxic and is not flammable when mixed with water. The weight ratio between water and organic compound is any ratio which permits the electrophoretic deposition of powdered getter materials and antisintering agents suspended in the mixture. However the volume ratio of water to organic compound is preferably in the range from 3:1 to 1:3. The most preferred ratios are from 1:1 to 1:2.5.

It is convenient to add a "binder" to the water organic compound mixture. The binder performs two functions: firstly it helps to maintain the getter material powders in suspension and secondly it provides a more cohesive deposit. It may be added to the liquid in an amount up to 15% by volume and preferably not less than 5%.

In the suspension the weight ratio of solids to liquids is preferably between 3:1 and 1:2 and more preferably between 2:1 and 1:1. Any binder capable of performing the above functions may be used. However a suitable binder has been found to be a solution of aluminium hydroxide in water which may be suitably prepared by dissolving aluminium turnings in a solution of aluminium nitrate according to methods well known in the art. A further advantage of using this binder is that it provides an acid solution having a value of pH between about 3 and 4 which ensures a sufficiently high and constant deposition rate of the materials in suspension upon the support when it is attached to the negative electrode of the power supply of the electrophoretic deposition apparatus.

To deposit a coating on the support it is immersed in a bath containing the materials in liquid suspension and a direct electric current is passed between the getter support as a first electrode and a second electrode which is held at a positive potential with respect to the support. It is found that the potential that need be applied is no more than about 60 V. At a potential greater than about 60 V, hydrogen starts to evolve at the electrode where the materials are being deposited. This evolution of hydrogen is highly undesirable as it interferes with the deposition process and produces a layer of deposited materials which is not sufficiently adherent to the support. Furthermore the electrophoretic deposition current is used more for the production of hydrogen than for the deposit with a subsequent reduction in the efficiency of the deposition process. The presence of hydrogen is also dangerous as it may react in an explosive manner with the atmosphere.

At potentials less than about 10 V excessively long times are required to deposit a sufficiently thick coating of the getter material and antisintering agent on the substrate. Furthermore control of the deposition process becomes more difficult as it is found that the deposit becomes less uniform in thickness. It is found that in general potentials of about 30 V for times of about 15 sec. are sufficient to give a satisfactory porous deposit of non-evaporable getter materials and antisintering agent.

When sufficient getter material and antisintering agent have been deposited the power supply is switched off and the getter support with its coating is removed from the electrophoretic deposition bath.

It is then preferable to rinse the getter device in an organic solvent such as diethyl ether or acetone to remove any loose particles of getter material or antisintering agent which could adhere to the surface of the deposit. In addition this removes any moisture from the getter device which is then dried in warm air after which it is placed in a vacuum oven. The coating of non-evaporable getter material is then sintered by means of induction heating at a temperature less than about 1100° C. and at a pressure less than about $10^{-3}$ Torr ($10^{-1}$ Pa) and preferably less than about $10^{-5}$ Torr ($10^{-3}$ Pa). The temperature is preferably in the range of about 850° C. to about 1000° C. The getter device is then allowed to cool to room temperature after which it is removed from the vacuum oven and is ready for use.

By sintering is meant, herein, the heating of the deposited particle layer for a time at a temperature sufficient to cause adhesion of the particles between themselves but not sufficient to cause a significant reduction of the free surface. It has been found that in order to obtain a deposited layer of maximum porosity the heating should take place following a suitable cycle which comprises the following steps: (1) rapid heating to a temperature of greater than 350° C. and less than 450° C. in a time of about 1 min., (2) maintenance of this temperature for about 15 min., so as to free all hydrogen from the hydride with an evolution such as to ensure a good porosity of the final product, without however being so violent as to provoke loss of adherence of the particles or to cause a plasma discharge near the getter device, (3) successively increasing the temperature up to about 930° C. in a time of about 2 min., (4) maintaining that temperature for about 5 min. for the final sintering, (5) free cooling by radiation within the switched off oven from which the getter is removed when its temperature is no greater than 50° C.

EXAMPLE 1

In a one liter plastic bottle were place 250 $cm^3$ of distilled water and 250 $cm^3$ of ethanol. 450 g of titanium hydride having a particle size of less than 60 u were added together with 166 g of an alloy of 84% Zr balance Al having a particle size of less than 54 u. 15 $cm^3$ of "wet binder" were then added and the plastic bottle was then sealed and agitated mechanically for a period of more than four hours. The suspension is now ready for use but if it is stored for any period of time before use it must then be reagitated for a period of at least two hours before use.

Figure 1:
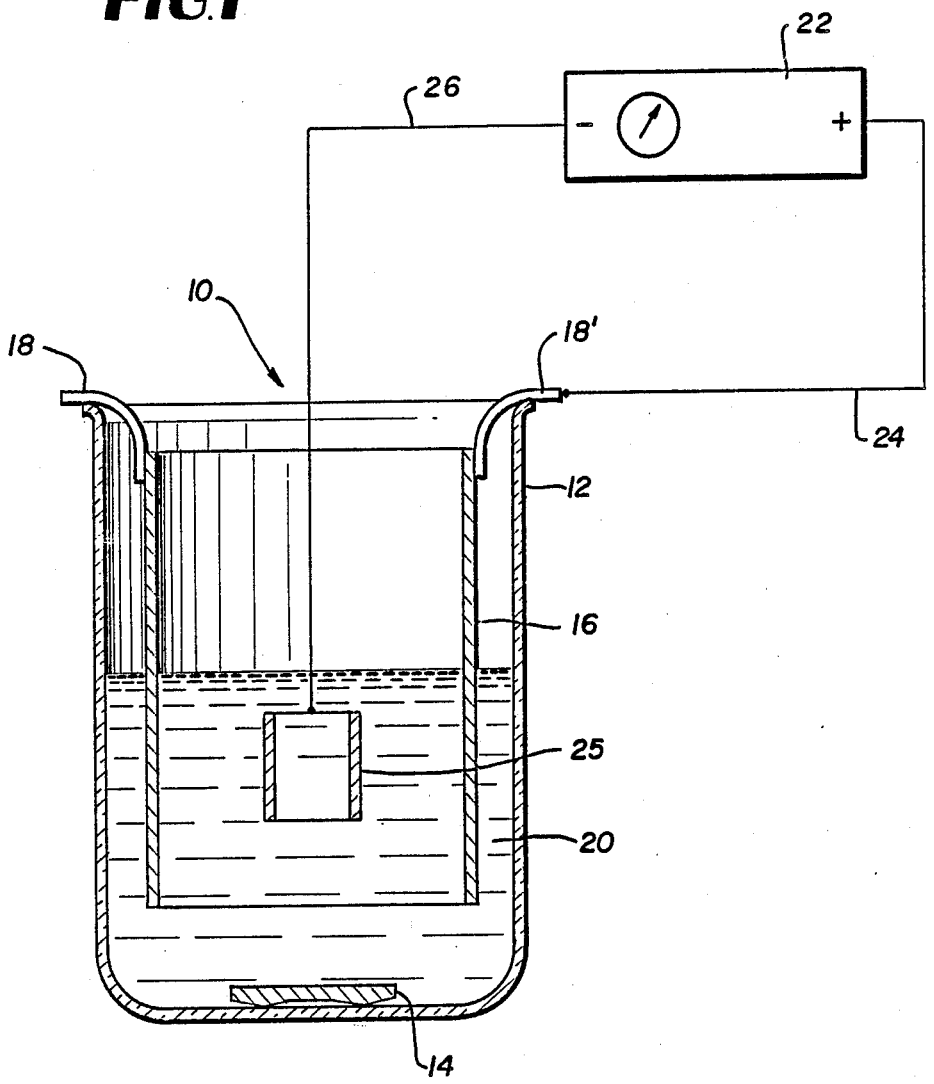
FIG. 1 is a cross-sectional representation of an experimental apparatus for the production of non-evaporable getter devices according to the present invention.

In order to deposit, simultaneously, getter material and antisintering agent electrophoretically from the suspension an electrophoretic apparatus 10 is used as shown diagramatically in FIG. 1. Apparatus 10 comprises a glass beaker 12 in which is placed a magnetic stirring element 14 and an electrode 16 which is a hollow cylinder of steel having a diameter of 7 cm and a thickness of about 2 mm and a height of 8.5 cm. Electrode 16 is suspended centrally within beaker 12 by means of small hooks 18, 18'. A freshly agitated suspension 20 prepared as described above was poured into the beaker until electrode 16 was covered to a height of about 2 cm and the positive electrode of a power supply 22 was connected to electrode 16 by means of wire 24 connected to small hook 18'. The negative electrode of power supply 22 was connected to a getter support 25 by means of a second wire 26. Although FIG. 1 shows the getter support in the form of a hollow cylinder, for the present example there was used a getter support in the form of a strip of stainless steel having a thickness of 0.094 mm (0.0037 inches). The strip of steel held by wire 26 was placed along the axis of electrode 16 within the suspension 20.

The magnetic stirring element 14 was stopped and a potential of 30 V was applied between the steel strip and electrode 16 for a period of 20 sec.

The strip was removed from the suspension and removed from wire 26, thoroughly rinsed in acetone and then dried in warm air for about one half hour.

The strip coated with a mixture of titanium hydride and Zr-Al alloy was then placed in a vacuum oven where the pressure was reduced to less than $10^{-5}$ Torr ($10^{-3}$ Pa) and its temperature was slowly increased up to 930° C. in a period of about 20 min. However, during the increase of temperature, when this had reached 400° C., this temperature was maintained for about 15 min. so as to remove the hydrogen from the composition. When the temperature reached 900° C. this was maintained for 5 min. and then the sample was allowed to cool to room temperature.

The coated strip was removed from the vaccum oven.

Figure 3:
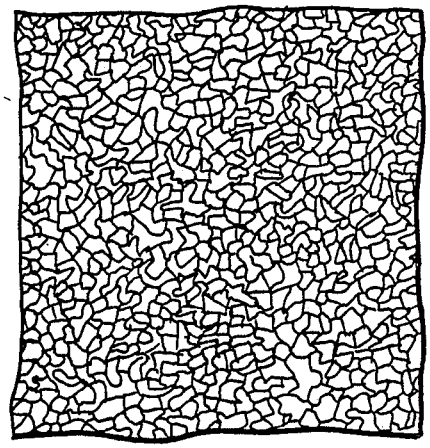
FIG. 3 is an enlargement of a portion of the surface shown in FIG. 2.
Figure 4:
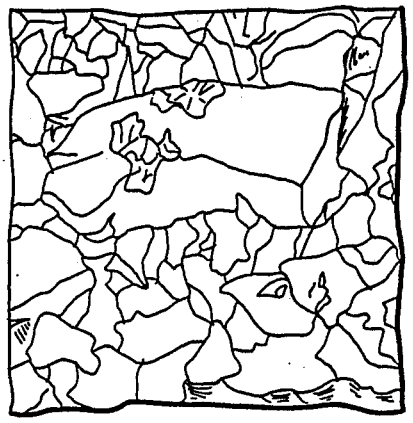
FIG. 4 is a further enlargement of the portion of the surface shown in FIG. 3.

FIGS. 2, 3 and 4 are scanning electron microscope photomicrographs of the surface of the electrophoretically coated strip of stainless steel at magnification of 16×, 400× and 1800× respectively. These photomicrographs were taken before the electrophoretically deposited layer had been subjected to the vacuum heat treatment and therefore before sintering.

FIG. 5 is an additional scanning electron microscope photomicrograph of the surface after the coated strip had been subjected to the vacuum heat treatment as described. This photomicrograph, having a magnification of 3000×, clearly shows that the heat treatment does not provoke any significant reduction in the porosity of the open structure of the deposited coating.

EXAMPLE 2

A cylindrical getter support was manufactured from a 1 cm wide stainless steel strip having a thickness of 0.094 mm (0.0037 inches). The procedure of example 1 was followed exactly with the sole difference that the getter support was replaced by the cylindrical getter support. A number of these cylindrical getter devices, electrophoretically coated with a mixture of titanium hydride and zirconium-aluminium alloy and subjected to the vacuum sintering process, were produced and subjected to gas sorption tests. The results of the gas sorption tests are reported in the curves of FIGS. 6 and 7.

EXAMPLE 3

This comparative Example was performed in order to compare the properties of a prior art getter with those of the present invention. Getter pellets were obtained which had been manufactured by the compression of a mixture of powders of titanium and a Zr-Al alloy. The pellets comprise a circular steel holder with an opening at one side having a diameter of 4 mm and an opening at the other side having a diameter of 5.5 mm. The pellet height was 4.3 mm. These pellets were subjected to the same gas sorption tests as the getter devices of Example 4. The gas sorption test results are reported for comparison on the graphs of FIGS. 6 and 7.

Discussion of gas sorption test results

FIG. 6 reports sorption speed of the getter devices as a function of the quantity of gas sorbed after an activation at 900° C. for 10 min. The pressure of the gas being sorbed above the getter device is held constant at $3\times10^{-6}$ Torr ($4\times10^{-4}$ Pa). Curve 1 is the gas sorption characteristic for the gas CO for a getter device of the present invention, manufactured as described in Example 4. Curve 2 is the sorption characteristic obtained by a getter device of the present invention when the gas being sorbed is $H_2$. The dashed lines near curves 1 and 2 are the sorption curves which would have been obtained if the gas inlet flow conductance had not limited the rate of flow of gas into the getter sample test chamber. Curve 3 represents the gas sorption characteristic for CO of a traditional getter device of Example 5. Curve 4 is the sorption characteristic of a traditional getter device obtained when the gas being sorbed was $H_2$.

FIG. 7 shows the sorption characteristic when the temperature of activation of the getter device was 500° C. for 10 min. Curves 1' and 2' refer to getter devices of the present invention for the gases CO and $H_2$ respectively whereas the curves 3' and 4' refer to the sorption characteristics of a traditional getter device again for CO and $H_2$ respectively.

It can be seen that the sorption characteristics of the getter devices of the present invention are vastly superior to those of traditional getter devices.

Referring now to FIG. 8, 9 and 10 there is shown a cathode ray tube having an electrophoretic getter device of the present invention incorporated therein. FIG. 8 shows a cross-sectional view of the electron gun region 400 of a cathode ray tube (CRT) 402. The glass neck 404 of the cathode ray tube 402 is in the form of a cylinder closed by a feed-through seal element 406. Element 406 supports an electron gun 408 within the CRT 402. Electron gun 408 comprises a series of electrodes, 410, 410', 410'', 410''', 410'''' etc. These electrodes are used to produce and accelerate a beam of electrons onto the phosphors of the CRT faceplate or screen (not shown) of the CRT. They are also involved in focusing the electron beam to produce a correctly sized spot of electrons on the phosphors to ensure a well defined image. It will be realized that the single electron gun 408 as shown in FIG. 8 may also be a composite structure of three electron guns such as those found in color television or display CRTs often known as delta or precision in-line guns.

The cathode ray tube, in operation, produces electrons from a cathode 412 which are accelerated through series of electrodes 410, 410', etc. in the form of a fine beam to eventually impinge upon the CRT screen. It is essential that within the cathode ray tube there is maintained a very high vacuum that is, a very low pressure of residual gases. This residual pressure should be lower than about $10^{-7}$ Torr ($10^{-5}$Pa). If the pressure within the CRT is higher than this value then at least two deleterious effects may take place. First, the electron beam may ionize an excessive number of residual gas atoms of molecules and these ions, on being accelerated towards the cathode may impair the cathode efficiency in a very short time. Second, the electrons on collision with the residual gas atoms or molecules can be deflected from the desired path and therefore result in a reduced image quality upon the CRT screen.

Although a barium getter device 414 is usually provided within the CRT and located in a suitable position (in this case by means of an antenna spring 416) for release of a film of barium getter material, which film rapidly sorbs residual gases, this film must not penetrate into the electron gun region 400 of the CRT. This is to avoid reduction of the work function of the series of electrodes 410, 410'', 410'' etc. which could result in short circuiting of the inter-electrode spaces with resulting damage to the electronic circuity outside the CRT. Unfortunately at the present time there is a tendency to reduce the dimensions of the neck diameter of the CRT and as a consequence the dimensions of the electron gun or guns within the neck. This results in a high resistence (low conductance) to the removal of residual gases from the electron gun to the gas pumping barium getter film. The high pressure of residual gases, produced by natural outgassing of the electron gun materials and also provoked by the heating of these materials by the cathode 412 can provoke distorsion of the electron beam already within the electron gun region itself. This becomes especially critical when high diffusion images are required of the CRT or even when a more conventional definition is required but the CRT dimensions are considerably reduced.

In order to better explain the invention reference is now made to FIGS. 9 and 10 in which FIG. 9 is a view taken along line 9—9' of FIG. 8, and FIG. 10 is a view taken along the 10—10' of FIG. 9. FIGS. 9 and 10 therefore effectively represent ultor electrode or anode 410'''' of FIG. 8. A getter device of the present invention 418 comprising a narrow thin strip of support metal on which has been electrophoretically depositied a powdered getter material sintered to keep high porosity and get good mechanical stability has been subsequently bent into a circular form and its ends spot welded at point 420. This getter means is then inserted into the ultor structure and held in place by means not shown. It will be evident that the strip could be replaced by a suitably coated wire. Furthermore the strip or wire could be placed in any one of the other electrodes such as 410, 410', 410'', 410'''. In addition if it is found that the pressure is too high in the electron gun region between the electron gun 408 and the glass neck 404 a similar wire or strip could be inserted in this region. Activation of the getter device may be performed by normal induction heating.

Although the wire or strip may be bent to shape before electrophoretically coating it with getter material it has been found that the wire or strip can be conveniently coated while still straight and then conveniently bent to shape after the sintering process. Surprisingly it has been found that on a bending even down to a radius of about 1 cm there is no cracking of peeling of the electrophoretically deposited coating nor are there found to be any loose particles.

What is claimed is:

1. A cathode ray tube comprising:

A. a cylindrical neck;

B. a feed-through sealing element positioned at one end of the neck, said sealing element closing said end of the neck;

C. an electron gun within said neck, said electron gun being supported by the sealing element; and D. a getter device located within the neck, said getter device comprising a getter support having an electrophoretic coating thereon of at least one member selected from the group consisting of Zr-Al alloys, Zr-Ni alloys, Zr-Fe alloys, Zr-Ti-Fe alloys, Zr-$M_1$-$M_2$ alloys wherein $M_1$ is vanadium or niobium and $M_2$ is nickel or iron, Zr, Ta, Hf, Ni, Ti, Th, U and hydrides thereof.

2. A cathode ray tube comprising:

A. a cylindrical neck;

B. a feed-through sealing element positioned at one end of the neck, said sealing element closing said end of the neck; and C. an electron gun within said neck, said electron gun being supported by the sealing element, said electron gun comprising a series of electrodes, at least one of said electrodes having a getter device therein, said getter device comprising a getter support having an electrophoretic coating of at least one member selected from the group consisting of Zr-Al alloys, Zr-Ni alloys, Zr-Fe alloys, Zr-Ti-Fe alloys, Zr-$M_1$-$M_2$ alloys wherein $M_1$ is vanadium or niobium and $M_2$ is nickel or iron, Zr, Ta, Hf, Ni, Ti, Th, U and hydrides thereof;

wherein said getter device is a ring having a diameter smaller than the diameter of the electrode; and wherein the getter device is encircled by the electrode.

3. A cathode ray tube of claim 2 wherein the getter device comprises a wire having thereon an electrophoretic deposition of at least one member selected from the group consisting of Zr-Al alloys, Zr, Ti and hydrides of Zr and Ti.

4. A cathode ray tube of claim 2 wherein said getter support comprises a flat metallic ribbon.

5. A cathode ray tube comprising:

A. a cylindrical neck;

B. a feed-through sealing element positioned at one end of the neck, said sealing element closing said end of the neck; and C. an electron gun within said neck, said electron gun being carried by the sealing element with a first end of the electron gun being adjacent the sealing element and a second end of the electron gun being located at a distance from the sealing element;

D. a plurality of electrodes positioned within said electron gun, each of said electrodes having a cylindrical shape and said electrodes being positioned such that the central axis of each of said electrodes is substantially coincidental with an axis of the cylindrical neck;

E. an ultor electrode, said ultor electrode comprising the electrode in the electron gun which is located adjacent the second end of the electron gun, said ultor electrode being the electrode furthest removed from the sealing element; and F. a getter device positioned within said ultor electrode, said getter device comprising a flat metallic ribbon having an electrophoretic coating thereon of at least one member selected from the group consisting of Zr-Al alloys, Zr, Ti, hydrides of Zr and hydrides of Ti;

wherein said getter device is ring shaped, said ring shape being formed by spot welding a first end of the flat metallic ribbon to a second end of the flat metallic ribbon; and wherein the diameter of the getter device is smaller than the diameter of the ultor electrode; and wherein the getter device is encircled by the ultor electrode such that a central axis of the ring-shaped getter device is substantially coincidental with the central axis of the ultor electrode.

* * * * *